US009457939B1

(12) United States Patent
Peters

(10) Patent No.: US 9,457,939 B1
(45) **Date of Patent: *Oct. 4, 2016**

(54) UNIVERSAL CONTAINER SEAL

(71) Applicant: Dan Peters, Jupiter, FL (US)

(72) Inventor: Dan Peters, Jupiter, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/629,255

(22) Filed: Feb. 23, 2015

Related U.S. Application Data

(63) Continuation-in-part of application No. 14/016,625, filed on Sep. 3, 2013, now Pat. No. 8,960,475.

(60) Provisional application No. 61/697,168, filed on Sep. 5, 2012.

(51) Int. Cl.
*B65D 41/02* (2006.01)

(52) U.S. Cl.
CPC ..... *B65D 41/023* (2013.01)

(58) Field of Classification Search
CPC ..... A47J 36/06; B65D 41/22; B65D 41/023; B65D 41/225
USPC ..... 220/287, 212.5, 212, 213, 780, 796, 220/801, 804, 227, 216; 229/404; D7/391
See application file for complete search history.

(56) References Cited

U.S. PATENT DOCUMENTS

| | | | | |
|---|---|---|---|---|
| 2,685,860 | A * | 8/1954 | Plakas | A61J 7/0046 116/316 |
| 3,040,897 | A * | 6/1962 | Holman | B65D 1/10 210/237 |
| D405,692 | S * | 2/1999 | Johnson | D9/443 |
| D659,464 | S * | 5/2012 | Albers | D7/354 |
| 2004/0262309 | A1* | 12/2004 | Edwards | B29C 45/1676 220/233 |
| 2012/0267279 | A1* | 10/2012 | Lesniak | A61L 9/12 206/524.1 |

* cited by examiner

*Primary Examiner* — Robert J Hicks
(74) *Attorney, Agent, or Firm* — H. John Rizvi; Gold & Rizvi, P.A.

(57) ABSTRACT

A universal container seal for sealing a container opening includes a resilient body having a top surface and a bottom surface. The body is further configured in a geometric plan form and having a width significantly greater than a thickness, the thickness being greater at a center of the resilient body than at a periphery of the resilient body. At least one gripping portion extends from the top surface of the body. A central portion of the bottom surface of the resilient body is concave. The concave central portion can be in vertical registration with one or more gripping portions.

20 Claims, 14 Drawing Sheets

UNIVERSAL CONTAINER SEAL

CROSS-REFERENCE TO RELATED APPLICATION

This Non-Provisional Utility Patent Application is a Continuation In Part and claims the benefit of co-pending U.S. Non-Provisional Utility Patent Application Ser. No. 14/016,625, filed on Sep. 3, 2013, which in turn claims the benefit of U.S. Provisional Patent Application Ser. No. 61/697,168, filed on Sep. 5, 2012, all of which are incorporated herein in their entirety.

FIELD OF THE INVENTION

The present disclosure generally relates to apparatuses and methods for sealing a container opening. More particularly, the present disclosure relates to a resilient lid adaptable to seal container openings by bearing upon the inside of the container opening.

BACKGROUND OF THE INVENTION

Preservation of food and drink has been of importance for humans for generations. One means of preserving meats includes packing the meat in salt, or storing the meat in a salt brine. Freezing has also been known for many years as a means of food preservation, but has only been practical in the past century as a result of the invention of commercial and home freezers. Basically, preservation involves preventing the oxidation and dehydration of the food or drink. Additionally, the prevention of the growth of bacteria and fungi is also an objective to aid in the preservation.

Materials such as paints, printing inks, emulsions, and liquid solutions in addition to foods and consumable liquids tend to dry out as a result of evaporation of a component of the liquid and form a layer at the surface as a result of oxidation. The problem arises as a result of the liquid being exposed to the ambient atmosphere where it is stored. Prevention of such evaporation requires a seal on the storage container openings to maintain air and fluid impermeability. Often this is accomplished with a cap or lid that is specifically designed to interact with the container in which the fluid or food article is stored. Plastic lids closely hold a flange of the container to maintain impermeability. Caps can be threaded onto the top of a bottle to force the rim of the bottle opening against a resilient seal bonded to the cap interior.

However, such fixed volume storage arrangements generally trap a significant amount of the ambient atmosphere within the container along with the substance to be stored, and especially so when the volume of the item to be stored is significantly smaller than the interior volume of the container. This volume of trapped atmosphere can still cause oxidation and permit conditions for the growth of bacteria and fungi. One solution has been to place the article to be stored in a plastic bag which is then vacuum sealed. While this is effective for some solid food items, the method becomes impractical for the storage of liquids or for the short term storage of small volume articles.

In general, current packaging designs vary throughout the industry and don't necessarily provide a consistent sealable covering for a container that both evacuates air from the container and maintains impermeability to both air and liquid. A primary problem is that covering materials such as a conforming lid, a plastic film or an aluminum foil must rely upon engagement with the top rim or outside of the container in order to provide a seal thus trapping ambient atmosphere in the container, as well as, the item to be stored.

Therefore, a universal container seal is needed that can be utilized on different sized containers and further, that can be engaged with an interior surface of the container to minimize the amount of ambient atmosphere sealed in conjunction with the article to be stored.

SUMMARY OF THE INVENTION

The present disclosure is generally directed to a universal container seal for sealing a container opening. The universal container seal includes a resilient body which is substantially planar when at rest or non-deformed. The resilient body is deformable into a plurality of upward, concave configurations, in which the body presents different concavities and resulting total widths. The resilient body is capable of being inserted in a container having a smaller cross-section, and adjusting to and sliding downwards against the inner walls of the container while allowing air to be expelled from beneath the container seal. The container seal can be used with containers having different shapes and/or sizes; the resilient body automatically adjusts its deformed configuration to the actual size and shape of the walls of the present container and provides an adequate sealing against the inner walls of the container once the container seal is pushed downward and placed adjacent or proximate to the contents of the container (e.g., food). In addition, the container seal can be used with tapered containers; the container seal gradually deforms to increasingly concave configurations as the container seal is inserted in the tapered container, adjusting to the decreasing width of the container and achieving a tight sealing at any given point of the container.

Introducing a first embodiment of the invention, the invention consists of a universal container seal for sealing a container opening, the seal comprising:

a resilient body having a top surface and a bottom surface, the body being resiliently deformable from a first position in which the body is configured in a geometric plan form to a second deformed position in which the body adopts an upwardly facing concave configuration, wherein in the first position the body has a width significantly greater than a thickness, the thickness being greater at a center of the resilient body than at a periphery of the resilient body; and at least one gripping portion extending from the top surface; wherein a central portion of the bottom surface is concave.

In a second aspect, at least one of the at least one gripping portion can be in vertical registration with the central portion of the bottom surface.

In another aspect, one of the at least one gripping portion can be a central gripping portion in vertical registration with the central portion of the bottom surface.

In another aspect, the at least one gripping portion can comprise a plurality of gripping portions extending upwardly from the top surface, wherein each gripping portion of the plurality of gripping portions is positioned more proximate to the periphery of the body than to the center of the body.

In another aspect, the at least one gripping portion can include at least one finger tab extending from the top surface of the body.

In another aspect, the at least one gripping portion comprises one of a loop, a knob, a cord, and a strip.

In another aspect, at least a portion of the bottom surface can be convex, the convexity intersecting at least a portion of the top surface plane, the intersection defining at least a portion of the periphery of the body.

In another aspect, the body and the at least one gripping portion are formed in a single, integrally molded unit.

Introducing another embodiment of the invention, the present invention consists of a universal container seal for sealing a container opening, the seal comprising:

a resilient body having a top surface and a bottom surface, the body being deformable from a first portion in which the body is configured in a geometric plan form to a second deformed position in which the body adopts an upwardly facing concave configuration, wherein in the first position the body has a width significantly greater than a thickness, and wherein in the first position a central portion of the bottom surface is concave and at least a portion of the bottom surface is convex, the convexity intersecting at least a portion of the top surface plane, the intersection defining at least a portion of a periphery of the body; and at least one gripping portion extending from the top surface.

Introducing yet another embodiment of the invention, the present invention consists of a universal container seal for sealing a container opening, the seal comprising:

a resilient body having a top surface and a bottom surface, the body further configured in a geometric plan form and having a width significantly greater than a thickness, the thickness being greater at a center of the resilient body than at a periphery of the resilient body; and at least one gripping portion extending from the top surface of the body, one of the at least one gripping portion being a central gripping portion that extends upwardly from the center of the top surface; wherein a central portion of the bottom surface in vertical registration with the central gripping portion is concave; and wherein the body and the at least one gripping portion are integrally molded.

In yet another embodiment, there is provided a method of forming a vacuum sealed container, comprising steps of:

obtaining a container having container contents stored therein;

obtaining a container seal, the container seal comprising a resilient body having a top surface and a bottom surface, wherein a central portion of the bottom surface is concave, the body being resiliently deformable from a first configuration in which the body is configured in a geometric plan and has a width significantly greater than a thickness, the thickness being greater at a center of the resilient body than at a periphery of the resilient body, the container seal further comprising at least one gripping portion extending from the top surface of the body;

moving the container seal downwardly past a top rim of the container through a top opening of the container;

deforming the resilient body into an upwardly facing concave configuration as the container seal is moved downwardly within a cavity defined by the container towards a bottom surface of the container;

forcing substantially an entire volume of air, between a top surface of the container contents and the bottom surface of the container seal, to escape between an inner wall surface of the container and the container seal periphery by applying downward pressure on the container seal top surface;

releasing the downward pressure when the container seal contacts the top surface of the container contents; and sealing the container by bearing the container seal periphery against the inner wall surface.

In another aspect, the container contents are provided in the form of a liquid.

These and other features, aspects, and advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, where like numerals denote like elements and in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
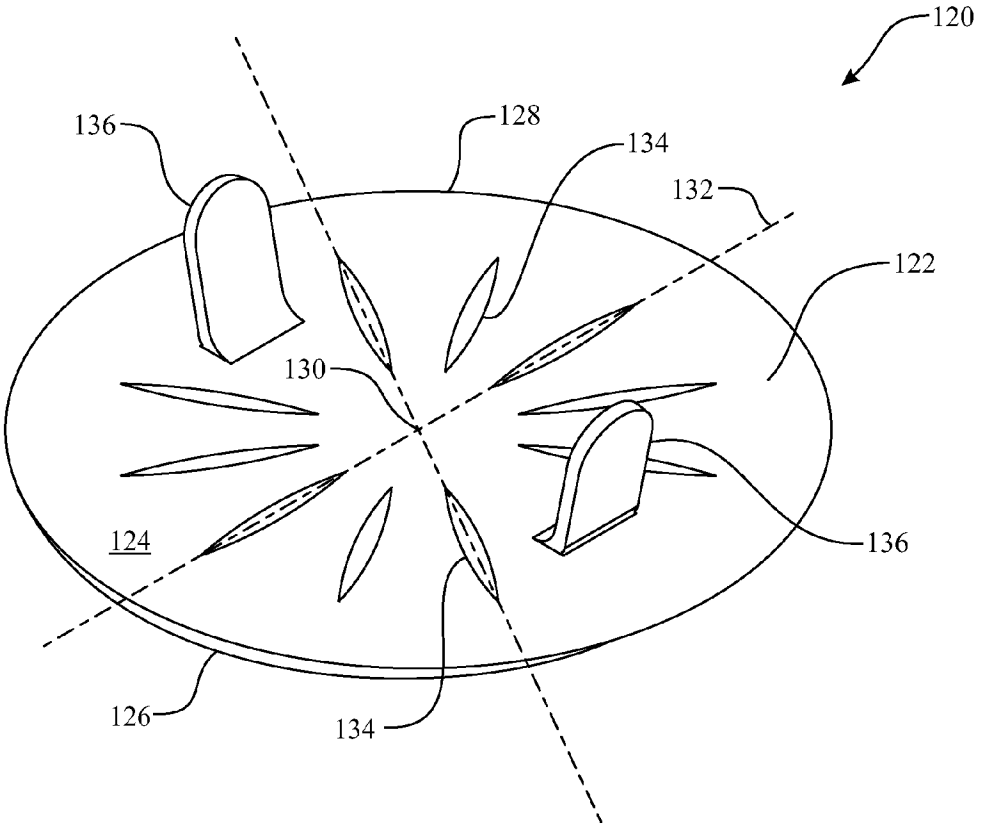
FIG. 1 presents a top isometric view of a universal circular container seal embodying the present invention.
Figure 2:
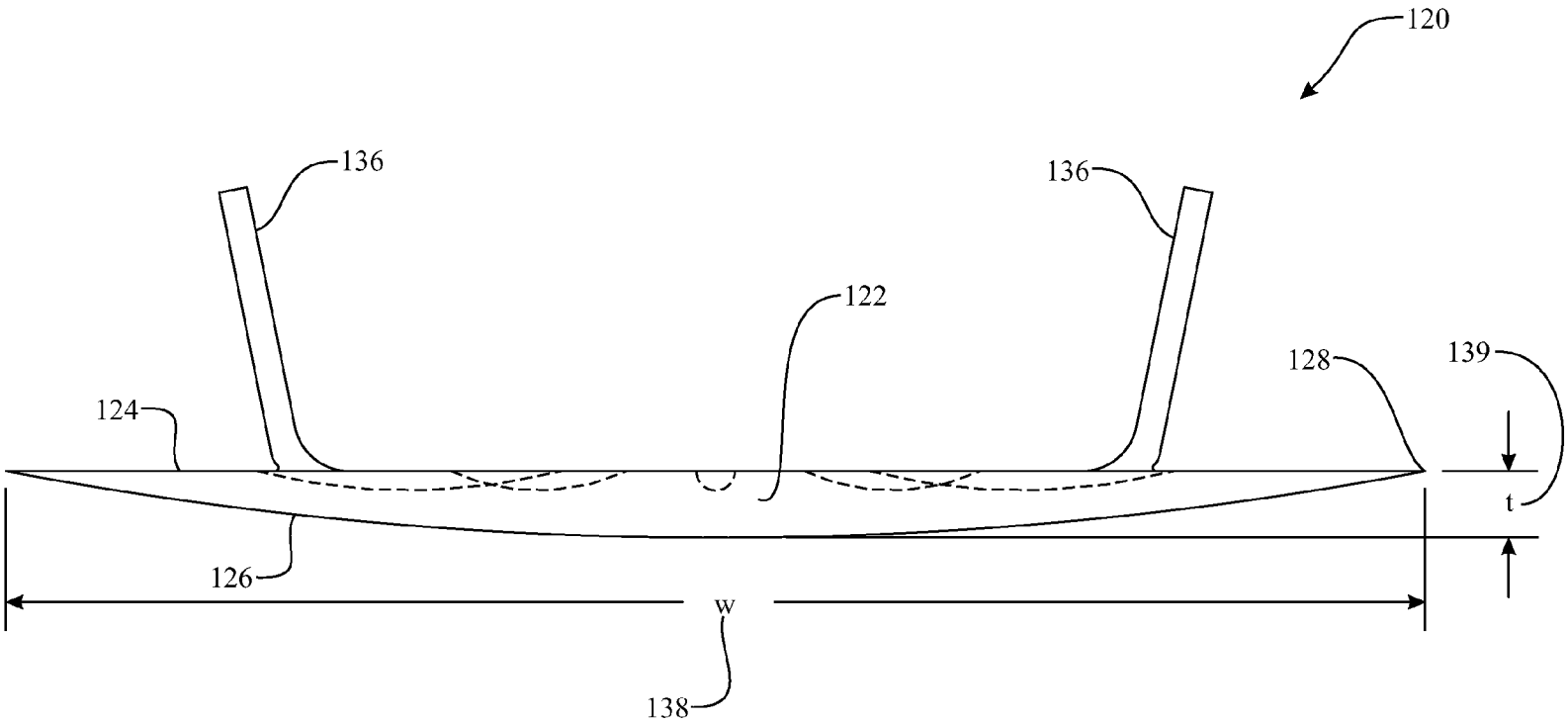
FIG. 2 presents a side elevation view of the universal circular seal.

In one exemplary implementation of the invention, a universal container seal 120 is shown in FIGS. 1-2 illustrating its various components where the universal container seal 120 has a resilient body 122 with a geometric plan form, in this case, a circular plan form. The resilient body has a planar top surface 124 and a convex bottom surface 126. The convex bottom surface 126 intersects the planar top surface 124 to define the circular perimeter 128 of the body 122. The circular perimeter 128 further defines a geometric center 130. As illustrated in FIG. 2, the width (w) 138 is significantly greater that the thickness (t) 139 of the resilient body 122 thereby contributing to the flexibility of the universal container seal 120. The material from which the body 122 is formed can be of a resilient moldable resin known in the industry or a resilient polymer material.

The universal container seal 120 also has at least one and, more preferably, a plurality of gripping portions, which in the present embodiment take the shape of finger tabs 136 with rounded end corners. The finger tabs 136 extend upwardly from the top surface 124 of the resilient body 122. The universal container seal 120 as illustrated includes two diametrically opposed finger tabs 136 and are more proximate to the periphery 128 than to the geometric center 130. The finger tabs 136 are preferably of the same material as the resilient body 122 and integrally molded therewith, or, alternatively, can be of a different material and embedded within the resilient body 122 during the molding process utilizing techniques known in the molding art.

The resilient body 122 further defines a plurality of grooves 134 in the top surface 124. The grooves 134 extend depth-wise into the body 122 but do not extend through the body 122 thereby maintaining the integrity and continuity of the bottom surface 126. Each groove 134 is aligned along a radial 132 extending from the geometric center 130 of the body 122 to the periphery 128 and is of a length less than the length of the radial 132 from the geometric center 130 to the periphery 128. For the sake of aesthetics, the grooves 134 are, most preferably, equally angularly spaced between the diametrically opposed finger tabs 136.

Figure 3:
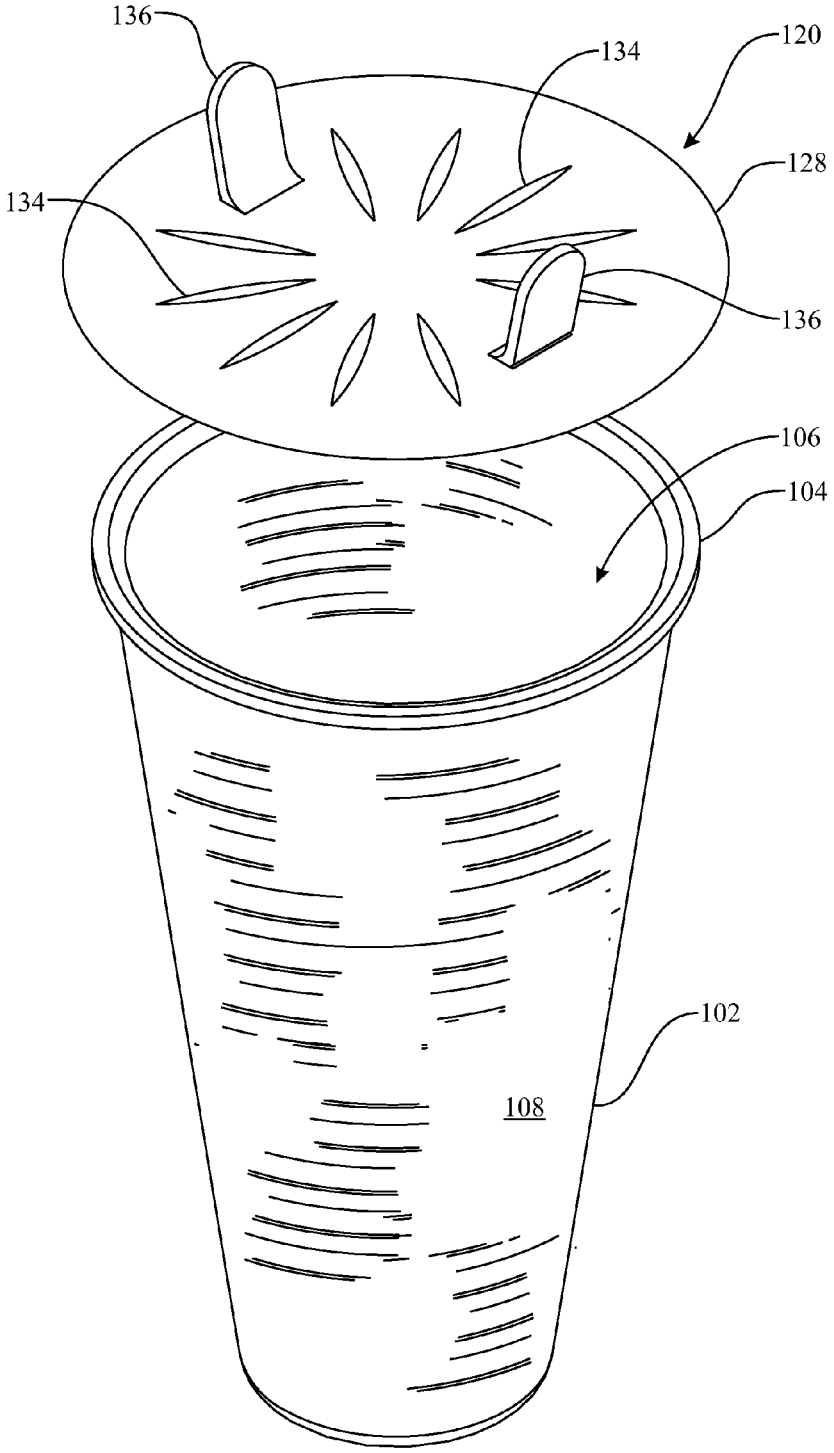
FIG. 3 presents an exploded top isometric view of the universal circular seal for insertion into a tumbler.

As best shown in FIGS. 3-6, the universal container seal 120 can be used to seal liquid 110 remaining within a container 102, such as a drinking tumbler. The container 102 has a top opening 106 defined by the top rim 104 and has tapered side walls 108, which have an inner surface 109. The universal container seal 120 is approximately centered over the opening 106 with the bottom surface 126 most proximate to the opening 106 (FIG. 3).

Figure 4:
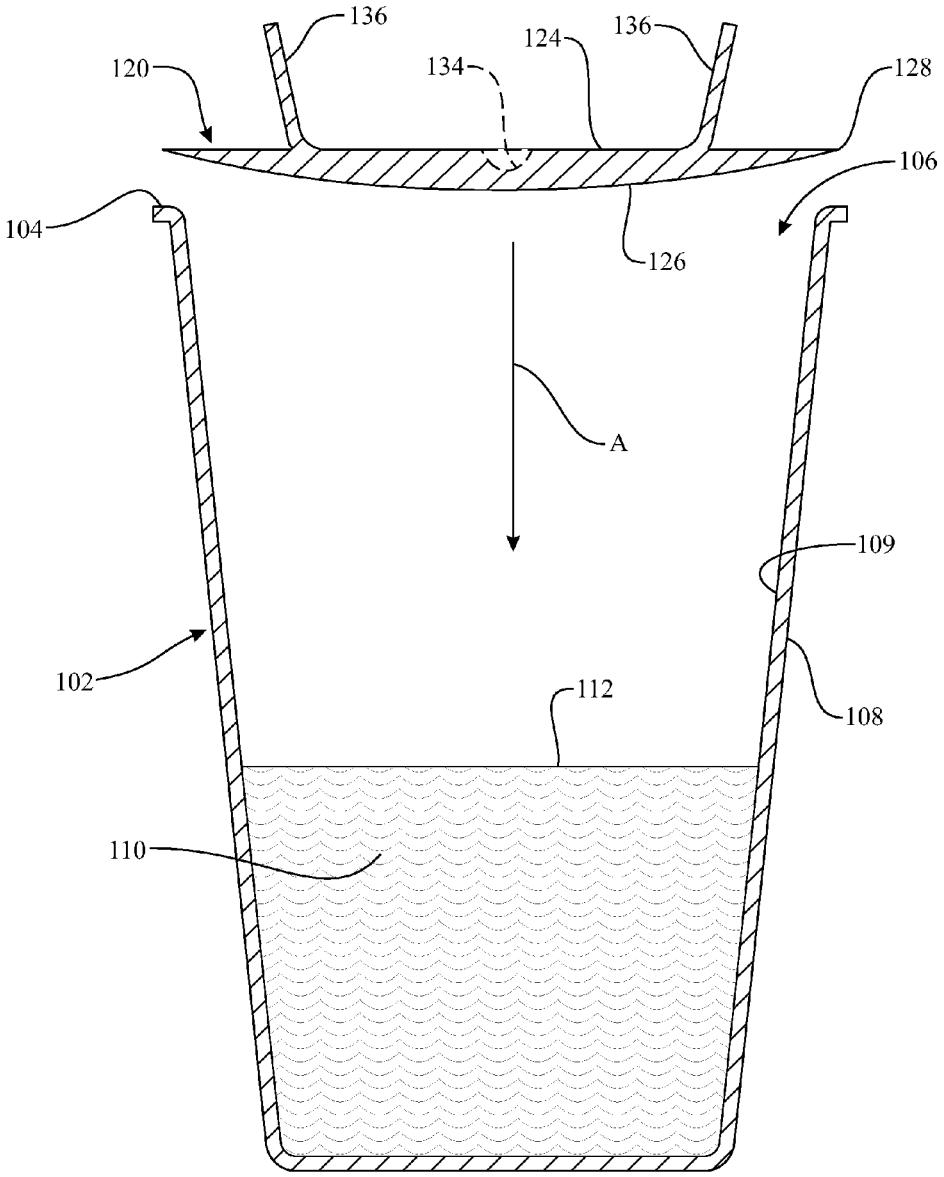
FIG. 4 presents a cross-sectional elevation view of the circular universal container seal in vertical registration with the opening of the tumbler prior to insertion of the seal.
Figure 5:
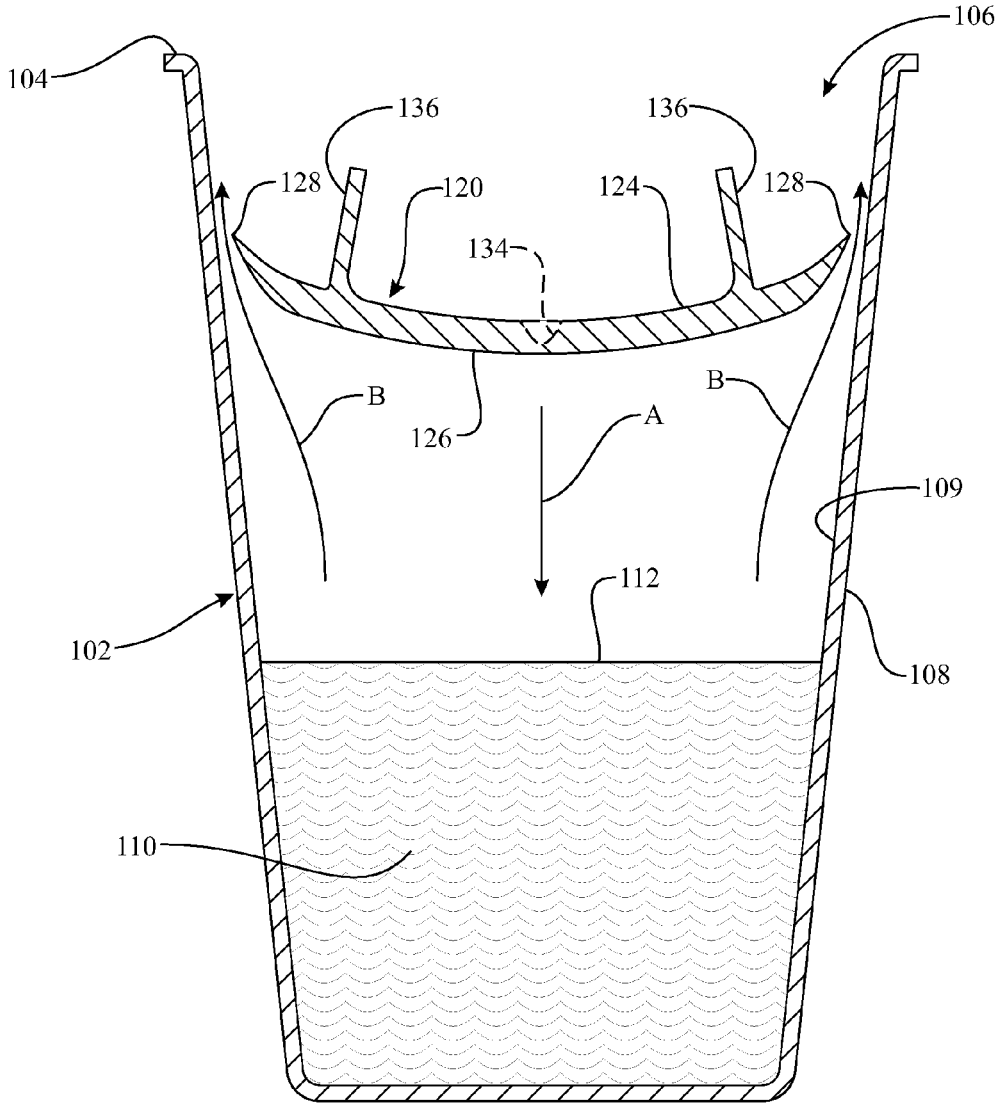
FIG. 5 presents the cross-sectional elevation view of the circular universal container seal partially inserted in the opening of the tumbler.

A user then translates the universal container seal 120 downwardly (Arrow "A", FIG. 4) past the top rim 104 through the opening 106, as best illustrated in FIGS. 4 and 5. Since the outer periphery 128 of the universal container seal 120 is greater than the inner diameter of the inner surface 109 of the container 102, the resilient body 122 deforms into an upwardly facing concave configuration. The relative thinness of the outer periphery 128 contributes to further resilience and flexibility of the outer portion of the resilient body 122. As the universal container seal 120 is translated downward (Arrow "A", FIG. 5) toward the surface 112 of the liquid 110, the air trapped between the liquid surface 112 and the universal container seal 120 escapes between the inner wall surface 109 and the seal periphery 128 (Arrows "B", FIG. 5).

Figure 6:
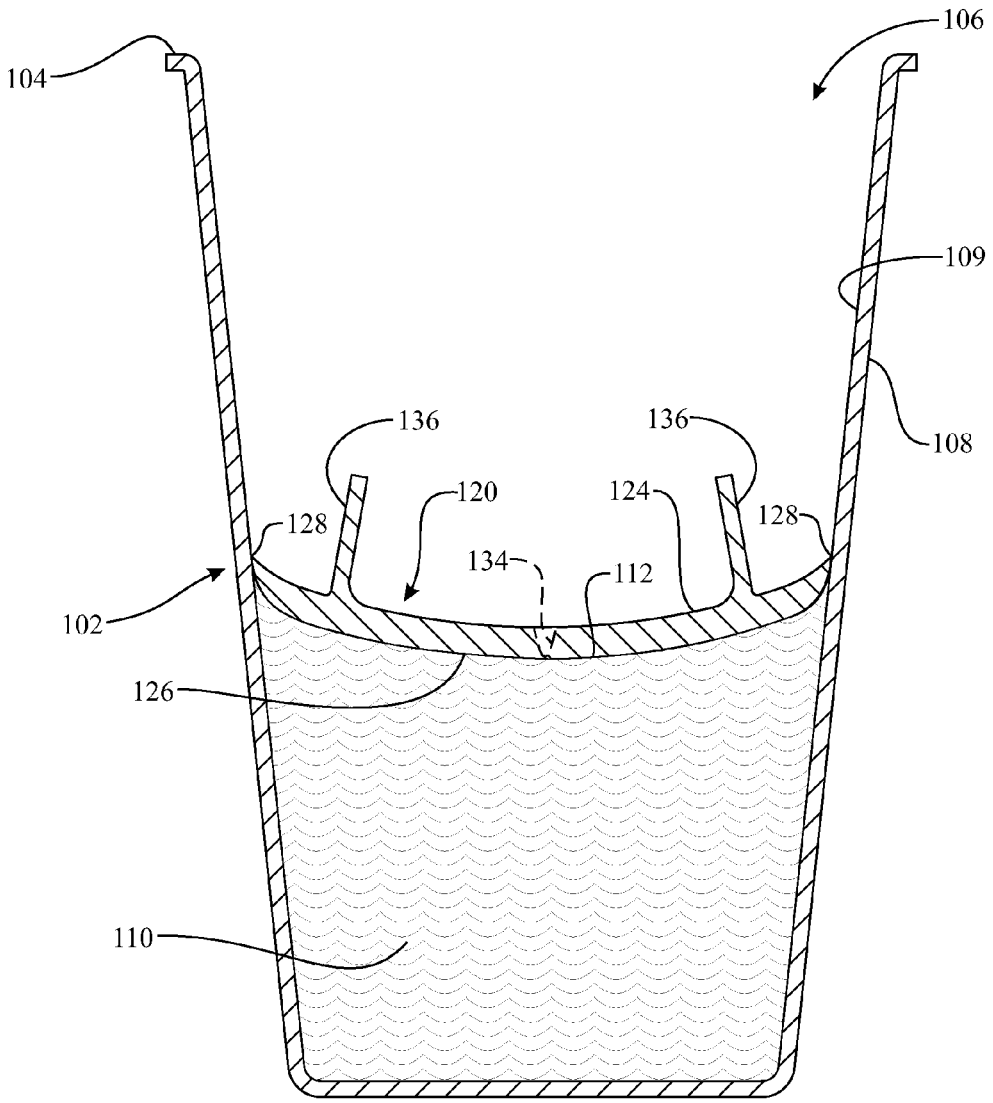
FIG. 6 presents the cross-sectional elevation view of the circular universal container seal fully inserted within the tumbler sealing the liquid within.

The resilient flexibility of a central portion of the body 122 is enhanced by the plurality of grooves 134 distributed about the top surface of the body 122. As the universal container seal 120 is translated downward and assumes an upwardly facing concave shape, each of the grooves 134 collapses upon itself to relieve at least a portion of the upper compressive stress incurred by the flexure of the top surface 124 of the body 122. When the bottom surface 126 of the universal container seal 120 is touching the liquid surface 112, downward pressure by the user is released. At that point, substantially an entire volume of air, which was trapped between the top surface 112 of the container contents 110 and the bottom surface of the container seal 120, is forced to escape via the inner wall surface 109 and the seal periphery 128. The periphery 128 and the outer portion of the bottom surface 126 of the body 122 bears against the inner wall 109 thereby sealing the liquid 110 within the container 102 and forming a vacuum sealed container (FIG. 6). As a result of the tapered nature of the container walls 108, the universal container seal 120 becomes increasingly more snug within the container 102 since the inner diameter of the container 102 decreases the further the universal container seal 120 is depressed into the container 102.

To remove the universal container seal 120 from its engaged position, the user grasps one or more of the finger tabs 136 extending upwardly from the top surface 124 and pulls the finger tabs toward the center of the container 102. This force disengages the outer portion of the bottom surface 126 from the inner wall 109 of the container and permits the ambient atmosphere to enter the void between the liquid surface 112 and the universal container seal 120 while the universal container seal 120 is being translated upwardly through the opening 106 of the container 102.

In this manner, a single universal container seal 120 can be utilized to seal a range of container sizes providing that the size of the outer periphery 128 of the universal container seal 120 is greater than the size of the interior wall surface 109 at the location the sealing relationship between the seal 120 and the container 102 is desired.

Figure 7:
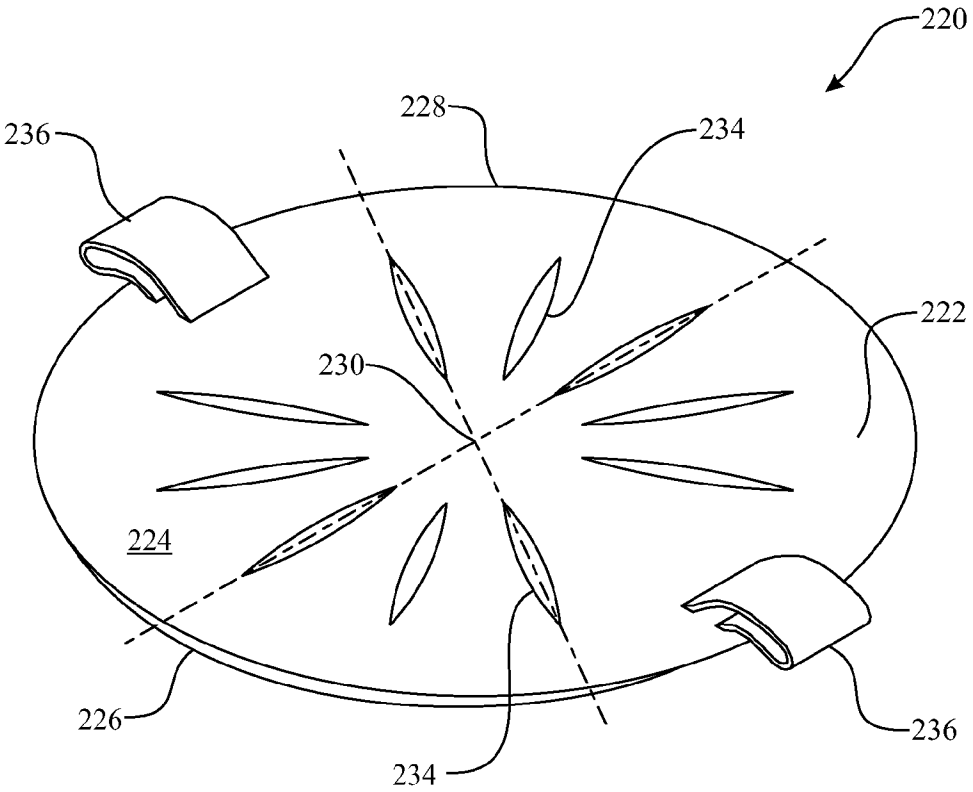
FIG. 7 presents an alternate embodiment universal circular seal having finger loops to aid in removal from a container.
Figure 8:
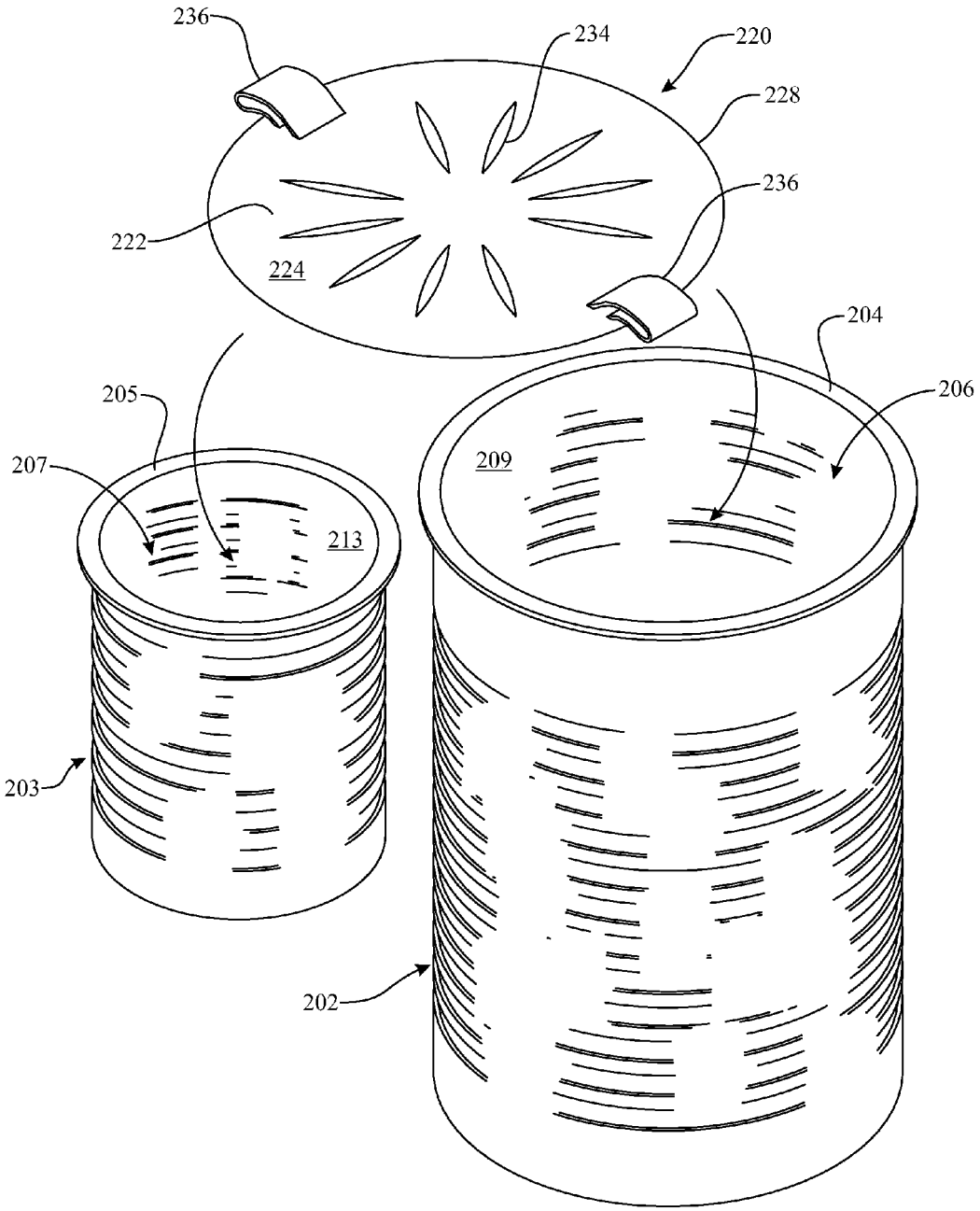
FIG. 8 presents an exploded top isometric view of the alternate embodiment universal circular seal introduced in FIG. 7 and able to seal either of two differently sized cylindrical containers.

An alternate embodiment universal container seal 220 is illustrated in FIGS. 7 and 8. Like features of the different embodiment features are identified with a like numerical reference preceded by the numeral "2". The universal container seal 220 has a resilient body 222 having a top surface 224 defining a plurality of grooves 234 and a bottom surface (not shown) configured similarly to universal container seal 120 described above. The universal container seal 220 further includes two gripping portions, which in the present embodiment are finger tabs 236 formed as loops. The finger tabs 236 extend upwardly and towards the side from the top surface 224 of the body 222, proximate to an outer periphery 228. The outer periphery 228 further defines a geometric center 230.

In use, the universal container seal 220 can be utilized to seal a cylindrical container 202, or alternatively, a smaller like cylindrical container 203. Since the diameter of the outer periphery 228 of the universal container seal 220 is larger than either opening 206, 207 defined by upper rims 204, 205 respectively, the resiliency and flexibility of the body 222 facilitates the engagement of the universal container seal 220 with either inner wall 209, 213 of the containers 202, 203 in a manner similar as the universal container seal 120, described above.

Figure 9:
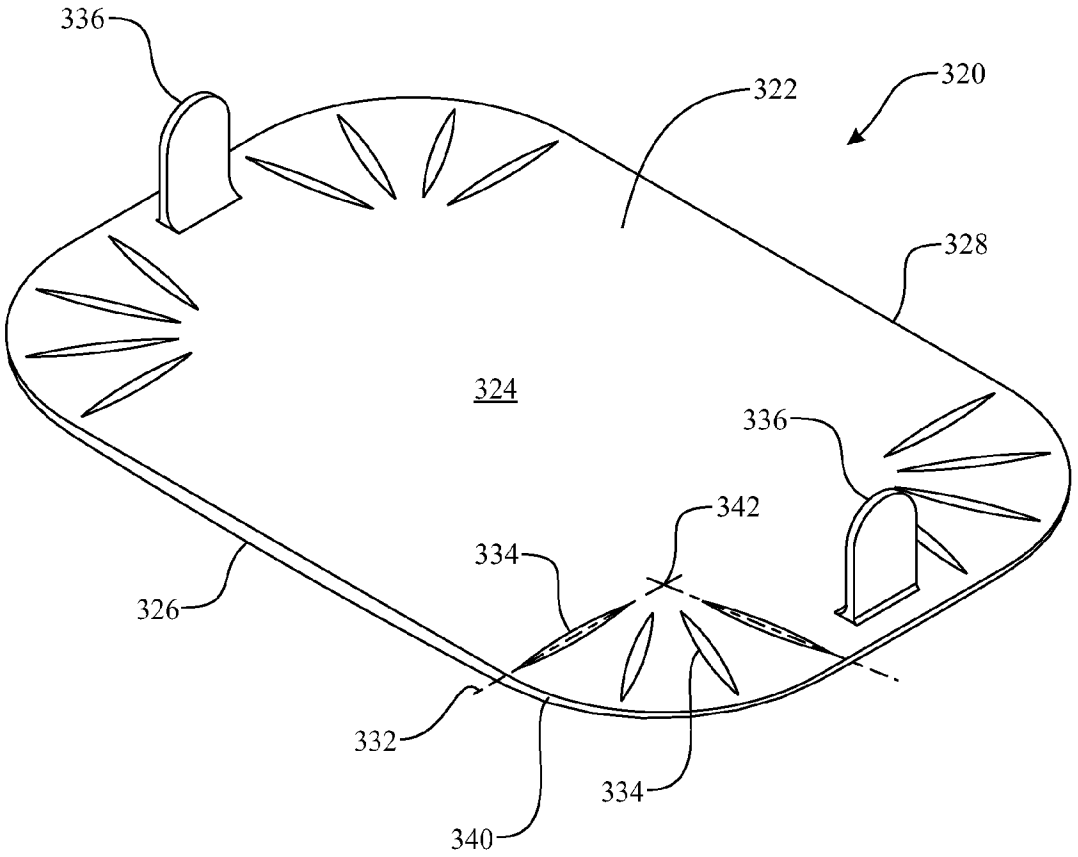
FIG. 9 presents a top isometric view of an alternate embodiment universal container seal including relief slits at the corners for a rectilinear container having arcuate corners.
Figure 10:
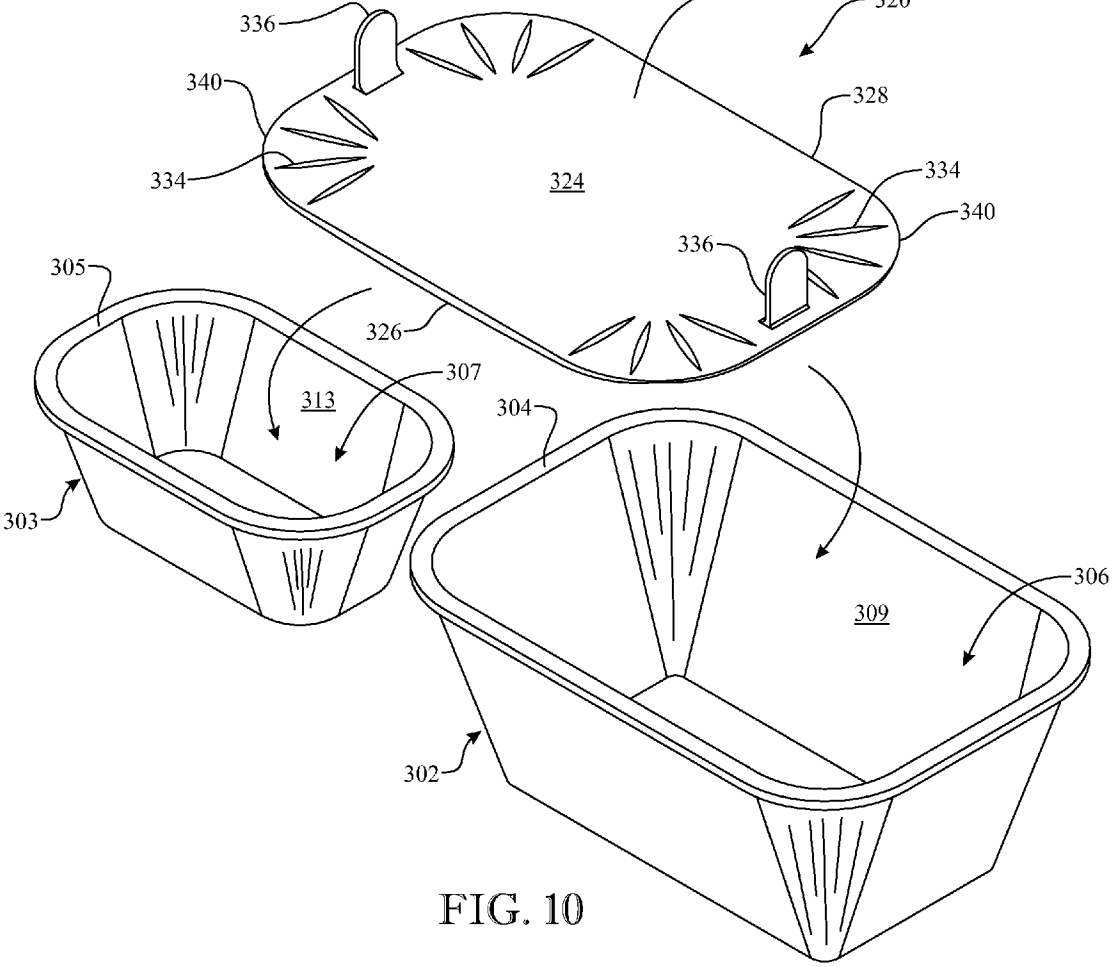
FIG. 10 presents an exploded top isometric view of the universal container seal for a rectilinear container introduced in FIG. 9 and able to seal either of two differently sized rectilinear containers.

A further alternate embodiment universal container seal 320 is illustrated is FIGS. 9 and 10. Like features of the different embodiment features are identified with a like numerical reference preceded by the numeral "3". The universal container seal 320 has a resilient body 322 having a top surface 324 and has a geometric plan form of a rectangle having radiused corners 340. Each radiused corner 340 has a radius center 342 proximate to the corner 340. The body 322 defines in the top surface 324, a plurality of grooves 334. The grooves 334 are intermediately positioned on radials 332 extending from the radiused corner center 342 to the periphery 328. The body 322 further includes a bottom surface 326, at least a portion of which is convexly configured similarly to universal container seal 120 described above. The universal container seal 320 further includes two gripping portions, which in the present embodiment are shaped as finger tabs 336 with rounded end corners. The finger tabs 336 are arranged at opposite ends of the universal container seal 320 intermediate between adjacent radiused corners 340, and extend upwardly from the top surface 324 of the body 322 and proximate to the outer periphery 328.

In use, the universal container seal 320 can be utilized to seal a rectangular container 302 having radiused corners, or alternatively, a smaller like rectangular container 303. Since the geometrical plan form of the outer periphery 328 of the universal container seal 320 is larger than either opening 306, 307 defined by upper rims 304, 305, respectively, the resiliency and flexibility of the body 322 facilitates the engagement of the universal container seal 320 with either inner wall 309, 313 of the containers 302, 303 in a manner similar as universal container seal 120 described above. The positioning of the grooves 334 proximate to each radiused corner 340 facilitate the flexure of the top surface 324 to conform to the radiused corners of the tapered interior wall surface 309, 313 of rectangular containers 302, 303, respectively.

Figure 11:
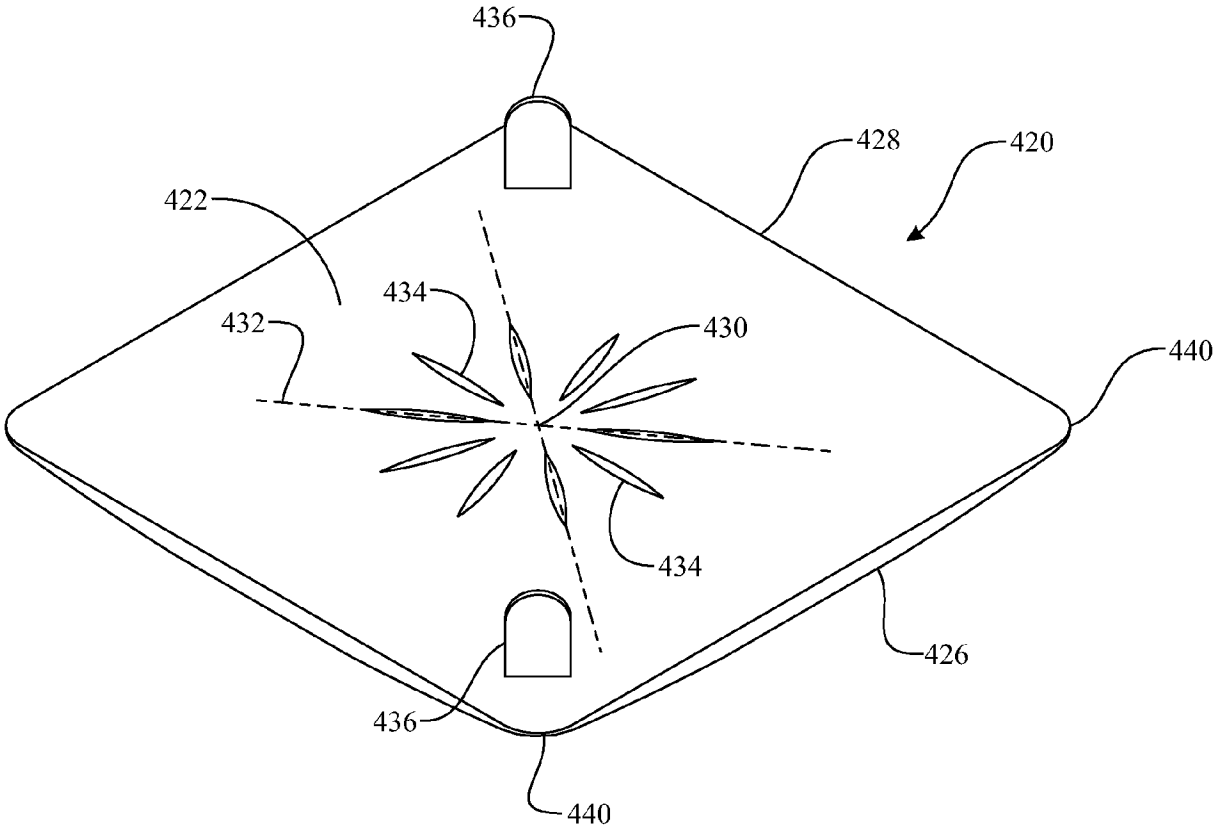
FIG. 11 presents a top isometric view of an alternate embodiment universal container seal for rectilinear containers including relief slits in the center of the universal container seal.
Figure 12:
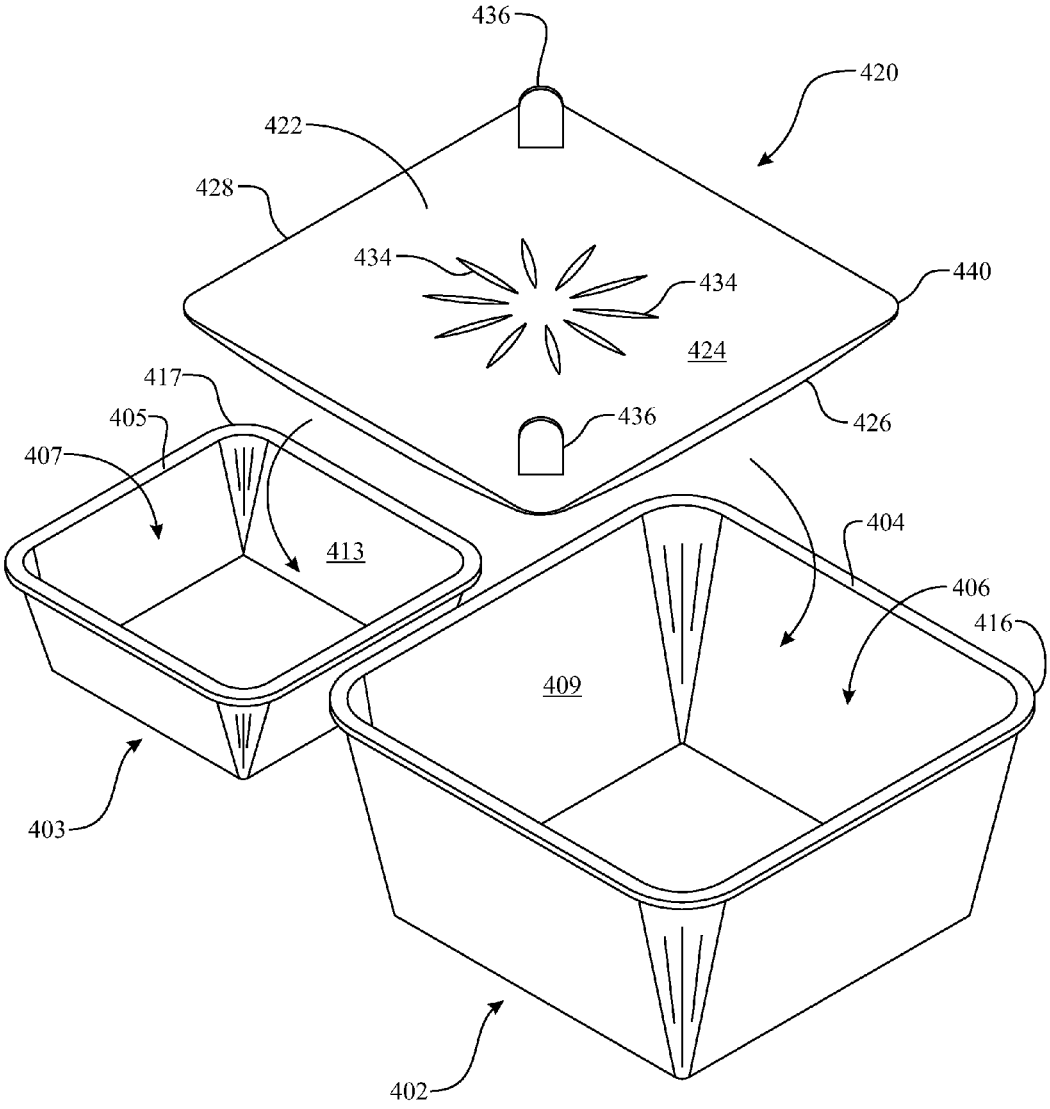
FIG. 12 presents an exploded top isometric view of the universal container seal for a rectilinear container introduced in FIG. 11 and able to seal either of two differently sized rectilinear containers.

A further alternate embodiment universal container seal 420 is illustrated is FIGS. 11 and 12. Like features of the different embodiment features are identified with a like numerical reference preceded by the numeral "4". The universal container seal 420 has a resilient body 422 having a top surface 424 and has a geometric plan form of a rectangle having minimally radiused corners 440. The body 422 defines in the top surface 424, a plurality of grooves 434 intermediately positioned on radials 432 extending outwardly from the body center 430 to the periphery 428. The body 422 further includes a bottom surface 426, at least a portion of which, at the periphery 428, is convexly configured similarly to universal container seal 120, described above. The universal container seal 420 further includes two gripping portions, again in the shape of finger tabs 436. The finger tabs 436 are arranged at diagonally opposite corners of the universal container seal 420, and extend upwardly from the top surface 424 of the body 422 and proximate to the outer periphery 428.

In use, the universal container seal 420 can be utilized to seal a rectangular container 402 having minimally radiused corners, or alternatively, a smaller like rectangular container 403. Since the geometrical plan form of the outer periphery 428 of the universal container seal 420 is larger than either opening 406, 407 defined by upper rims 404, 405 respectively, the resiliency and flexibility of the body 422 facilitates the engagement of the universal container seal 420 with either inner wall 409, 413 of the containers 402, 403 in a manner similar as universal container seal 120 described above. The central positioning of the grooves 434 proximate to the body center 430 facilitate the flexure of the top surface 424 to an insertion force applied proximate to the body center 430 for engagement with the tapered interior wall surface 309, 313 of rectangular containers 302, 303, respectively.

Figure 13:
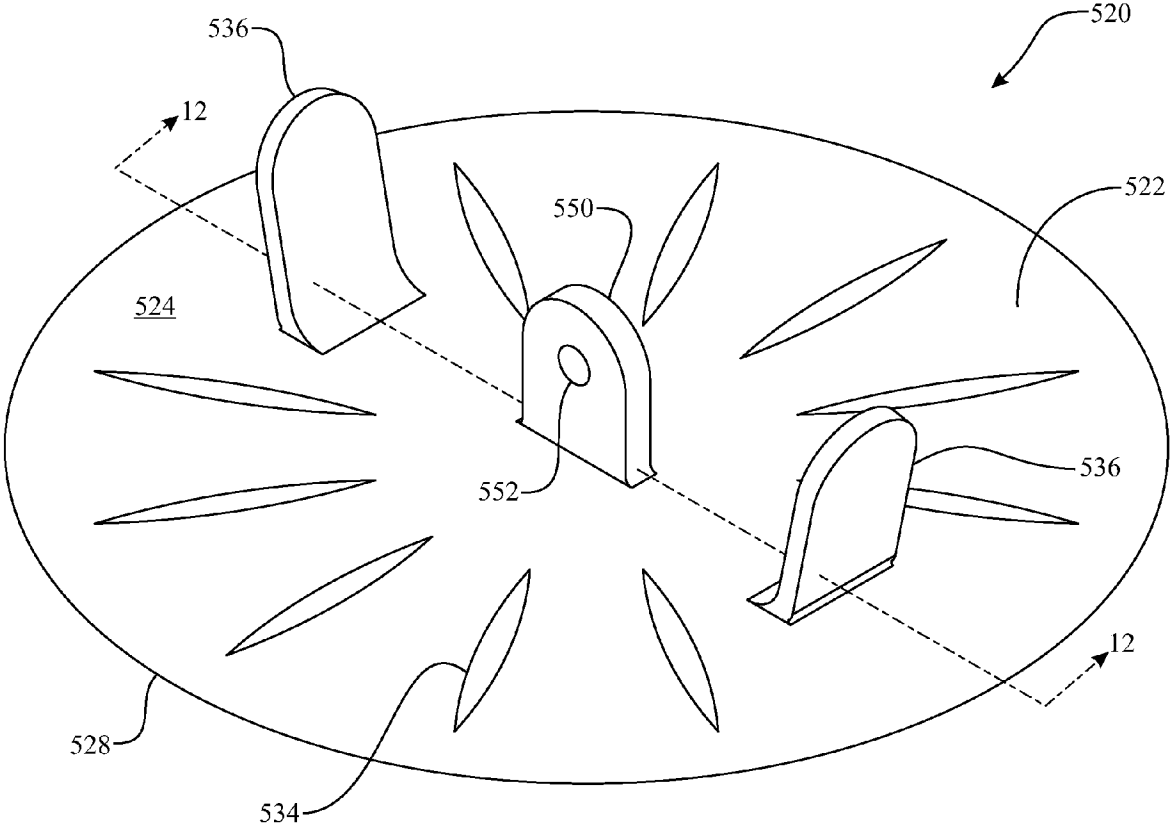
FIG. 13 presents an alternate embodiment universal circular seal including a center gripping portion.
Figure 14:
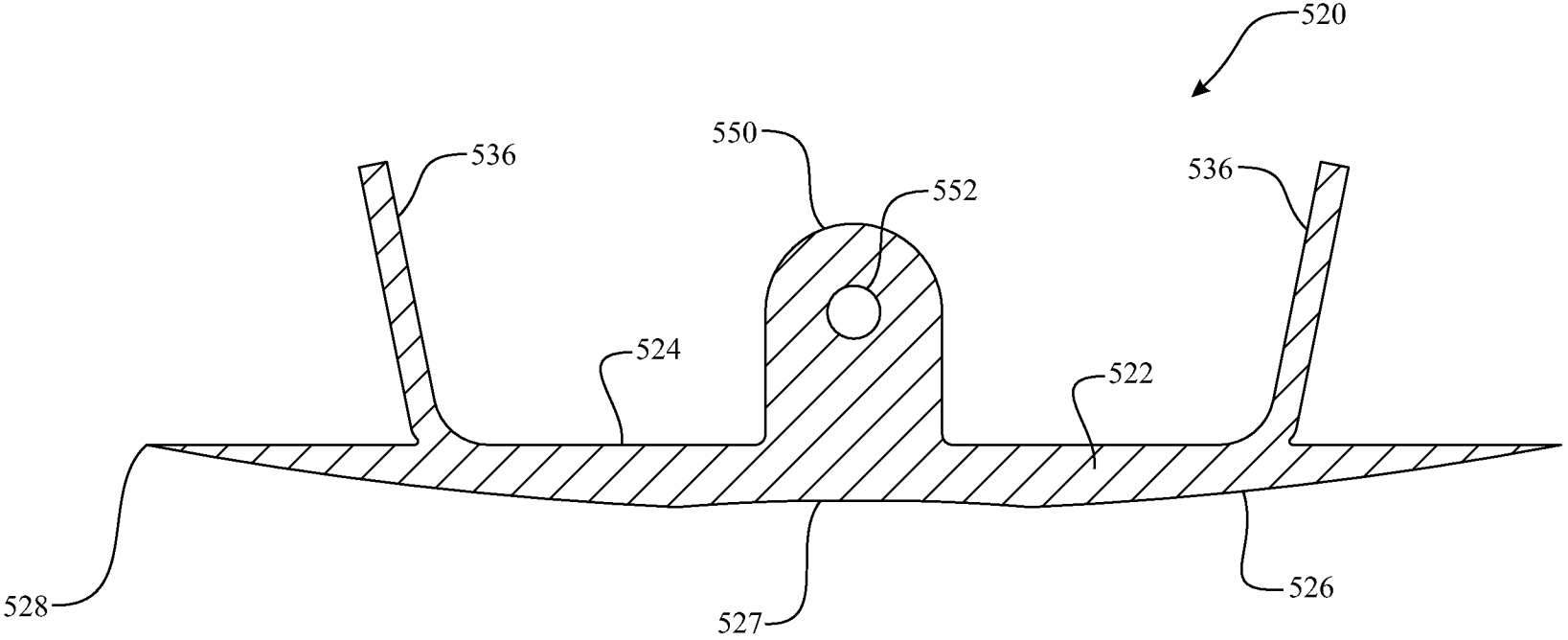
FIG. 14 presents a cross-sectional view of the universal circular seal shown in FIG. 13 and taken along the line 14-14, FIG. 13.

Another alternate embodiment universal container seal 520 is illustrated in FIGS. 13 and 14. Like features of the different embodiment features are identified with a like numerical reference preceded by the numeral "5". The universal container seal 520 has a circular geometric plan form and includes a resilient body 522 having a top surface 524 defining a plurality of radially extending grooves 534 and a bottom surface 526 convexly configured similarly to universal container seal 120 described above. The universal container seal 520 includes two gripping portions in the shape of finger tabs 536, extending upwardly from the top surface 524 of the body 522 and proximate to the outer periphery 528. In addition, a central, third gripping portion, which takes the form of a finger tab and will thus be hereinafter referred to as central finger tab 550, extends upwardly from the center of the body 522. The central finger tab 550 defines a hole 552 therethrough, which can be utilized for the attachment of a cord or chain (not shown). The bottom surface 526 includes a central concave portion 527. In the present embodiment, the central concave portion 527 is in vertical registration with the central finger tab 550. The central finger tab 550 aids in the sealing insertion and removal of the universal container seal 520, as a centrally located finger tab 550 provides a more user-convenient grasping location for manipulation of the container seal 520. Moreover, the concave portion 527 provides a suction mechanism for attaching the container seal 520 to a flat surface. This feature provides an added advantage of allowing storage of the container seal 520 in a convenient manner, such as by attaching the concave portion 527 via a suctioning attachment to a vertically disposed panel of a cabinet wall, for example. In those embodiments in which the concave portion 527 is in vertical registration with one or more finger tabs or other gripping portions, the suctioning attachment may be facilitated by gripping the one or more finger tabs while pushing the container seal towards the vertically disposed panel or surface.

As one skilled in the art will understand, the embodiments of FIGS. 1, 7, 9 and 11 may also be provided with a concave portion similarly to the embodiment of FIGS. 13 and 14. In other words, the concave portion can be present irrespective of the number and location of the gripping portions, and irrespective of the actual shape of the container seal, in accordance with the claims as included herein.

In some embodiments, any one of the one or more gripping portions comprised in the universal container seal can be shaped differently to a finger tab. For instance, the gripping portion can be shaped as a loop, a knob, a cord, a strip or other protrusion which can be gripped, displaced or pulled by a user's finger(s).

In addition, further embodiments are contemplated in which the universal container seal includes a single gripping portion, which is offset from the center of the container seal body. Further embodiments are contemplated in which two or more gripping portions are included, and arranged according to any given symmetrical, non-symmetrical, regular or irregular distribution along the container seal body.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A universal container seal for sealing a container opening, said seal comprising:

a resilient body having a top surface and a bottom surface, said body being resiliently deformable from a first position in which said body is configured in a geometric plan form to a second deformed position in which said body adopts an upwardly facing concave configuration, wherein in said first position the body has a width significantly greater than a thickness, said thickness being greater at a center of said resilient body than at a periphery of said resilient body; and at least one gripping portion extending from said top surface; wherein a central portion of said bottom surface is concave.

2. The universal container seal of claim 1, wherein at least one of said at least one gripping portion is in vertical registration with said central portion of said bottom surface.

3. The universal container seal of claim 1, wherein one of said at least one gripping portion is a central gripping portion in vertical registration with said central portion of said bottom surface.

4. The universal container seal of claim 1, wherein said at least one gripping portion comprises a plurality of gripping portions extending upwardly from said top surface, wherein each gripping portion of said plurality of gripping portions is positioned more proximate to said periphery of said body than to said center of said body.

5. The universal container seal of claim 1, wherein said at least one gripping portion comprises at least one finger tab extending from said top surface of said body.

6. The universal container seal of claim 1, wherein said at least one gripping portion comprises one of a loop, a knob, a cord, and a strip.

7. The universal container seal of claim 1, wherein at least a portion of said bottom surface is convex, said convexity intersecting at least a portion of said top surface, said intersection defining at least a portion of said periphery of said body.

8. The universal container seal of claim 1, wherein said body and said at least one gripping portion are formed in a single, integrally molded unit.

9. A universal container seal for sealing a container opening, said seal comprising:

a resilient body having a top surface and a bottom surface, said body being deformable from a first portion in which said body is configured in a geometric plan form to a second deformed position in which said body adopts an upwardly facing concave configuration, wherein in said first position the body has a width significantly greater than a thickness, and wherein in said first position a central portion of said bottom surface is concave and at least a portion of said bottom surface is convex, said convexity intersecting at least a portion of said top surface, said intersection defining at least a portion of a periphery of said body; and at least one gripping portion extending from said top surface.

10. The universal container seal of claim 9, wherein at least one of said at least one gripping portion is in vertical registration with said central portion of said bottom surface.

11. The universal container seal of claim 9, wherein one of said at least one gripping portion is a central gripping portion in vertical registration with said central portion of said bottom surface.

12. The universal container seal of claim 9, wherein said at least one gripping portion comprises a plurality of gripping portions extending upwardly from said top surface, wherein each gripping portion of said plurality of gripping portions is positioned more proximate to said periphery of said body than to said center of said body.

13. The universal container seal of claim 9, wherein said at least one gripping portion comprises at least one finger tab extending from said top surface of said body.

14. The universal container seal of claim 9, wherein said at least one gripping portion comprises one of a loop, a knob, a cord, and a strip.

15. The universal container seal of claim 9, wherein said body and said at least one gripping portion are formed in a single, integrally molded unit.

16. A universal container seal for sealing a container opening, said seal comprising:

a resilient body having a top surface and a bottom surface, said body further configured in a geometric plan form and having a width significantly greater than a thickness, said thickness being greater at a center of said resilient body than at a periphery of said resilient body; and at least one gripping portion extending from said top surface of said body, one of said at least one gripping portion being a central gripping portion that extends upwardly from said center of said top surface; wherein a central portion of said bottom surface in vertical registration with said central gripping portion is concave; and wherein said body and said at least one gripping portion are integrally molded.

17. The universal container seal of claim 16, wherein another of said at least one gripping portion is positioned more proximate to said periphery of said body than to said center of said body.

18. The universal container seal of claim 16, wherein said at least one gripping portion comprises at least one finger tab extending from said top surface of said body.

19. The universal container seal of claim 16, wherein said at least one gripping portion comprises one of a loop, a knob, a cord, and a strip.

20. The universal container seal of claim 16, wherein at least a portion of said bottom surface is convex, said convexity intersecting at least a portion of said top surface, said intersection defining at least a portion of said periphery of said body.

* * * * *